US007424951B2

(12) United States Patent
Hu

(10) Patent No.: US 7,424,951 B2
(45) Date of Patent: Sep. 16, 2008

(54) HANGER FOR WRENCH

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 523 days.

(21) Appl. No.: 10/978,593

(22) Filed: Nov. 1, 2004

(65) Prior Publication Data

US 2006/0091038 A1 May 4, 2006

(51) Int. Cl.
*B65D 73/00* (2006.01)
*B65D 75/56* (2006.01)

(52) U.S. Cl. ..... 206/349; 206/376; 206/495; 206/806; 206/477

(58) Field of Classification Search ..... 206/349, 206/372, 376–378, 382, 477, 478, 480, 481, 206/486–489, 495, 806; 211/70.6
See application file for complete search history.

(56) References Cited

U.S. PATENT DOCUMENTS

| | | | | |
|---|---|---|---|---|
| 4,450,961 | A * | 5/1984 | Bies et al. | 206/349 |
| 4,718,554 | A * | 1/1988 | Barbato | 206/477 |
| 5,988,381 | A * | 11/1999 | Ling | 206/349 |
| 6,375,005 | B1 * | 4/2002 | McCann | 206/349 |
| 7,210,663 | B2 * | 5/2007 | Wheeler et al. | 248/309.1 |
| 2004/0099553 | A1 * | 5/2004 | Chen | 206/349 |
| 2005/0155945 | A1 * | 7/2005 | Kao | 211/70.6 |
| 2007/0102382 | A1 * | 5/2007 | Tuan Mu | 211/70.6 |

* cited by examiner

*Primary Examiner*—Mickey Yu
*Assistant Examiner*—Steven A. Reynolds
(74) *Attorney, Agent, or Firm*—Alan Kamrath; Kamrath & Associates PA

(57) ABSTRACT

A hanger is disclosed for a wrench. The wrench includes a head and an insert connected with the head. The hanger includes a board and an aperture defined in the board for receiving the insert of the wrench. The edge of the aperture can hold the insert in position because of friction.

12 Claims, 12 Drawing Sheets

HANGER FOR WRENCH

BACKGROUND OF INVENTION

1. Field of Invention

The present invention relates to a hanger for a wrench.

2. Related Prior Art

Referring to FIG. 12, a conventional hanger includes a board 100 and a hollow joint 200. The board 100 includes a slot 104 defined at an end thereof for hanging a wrench 300 to a wall. The board 100 includes a rod 102 formed thereon. The rod 102 includes teeth 103 formed at a periphery thereof. The hollow joint 200 includes a hexagonal periphery and a substantially cylindrical internal wall. Teeth (not shown) are formed on the internal wall of the hollow joint 200. The teeth of the joint 200 match the teeth 103 of the rod 102 so that the hollow joint 200 can be engaged with the board 100. A wrench 300 includes a box end 302 and a ring 301 received in the box end 302. The wrench 300 can be hung on the hollow joint 200. The hanger is however complicated structurally and involves complicated fabrication and results in a high cost. Furthermore, a user cannot try the wrench 300 on the hanger.

The present invention is therefore intended to obviate or at least alleviate the problems encountered in the prior art.

SUMMARY OF INVENTION

The primary objective of the present invention is to provide a structurally simple hanger for a wrench.

A hanger is disclosed for a wrench. The wrench includes a head and an insert connected with the head. The hanger includes a board and an aperture defined in the board for receiving the insert of the wrench. The edge of the aperture can hold the insert in position because of friction.

The primary advantage of the hanger of the present invention is structural simplicity. Another advantage of the hanger of the present invention is that a user can test the wrench on the hanger.

Other objects, advantages, and novel features of the invention will become more apparent from the following detailed description when taken in conjunction with the drawings.

BRIEF DESCRIPTION OF DRAWINGS

The present invention will be described through detailed illustration of embodiments referring to the drawings.

DETAILED DESCRIPTION OF EMBODIMENTS

Figure 1:
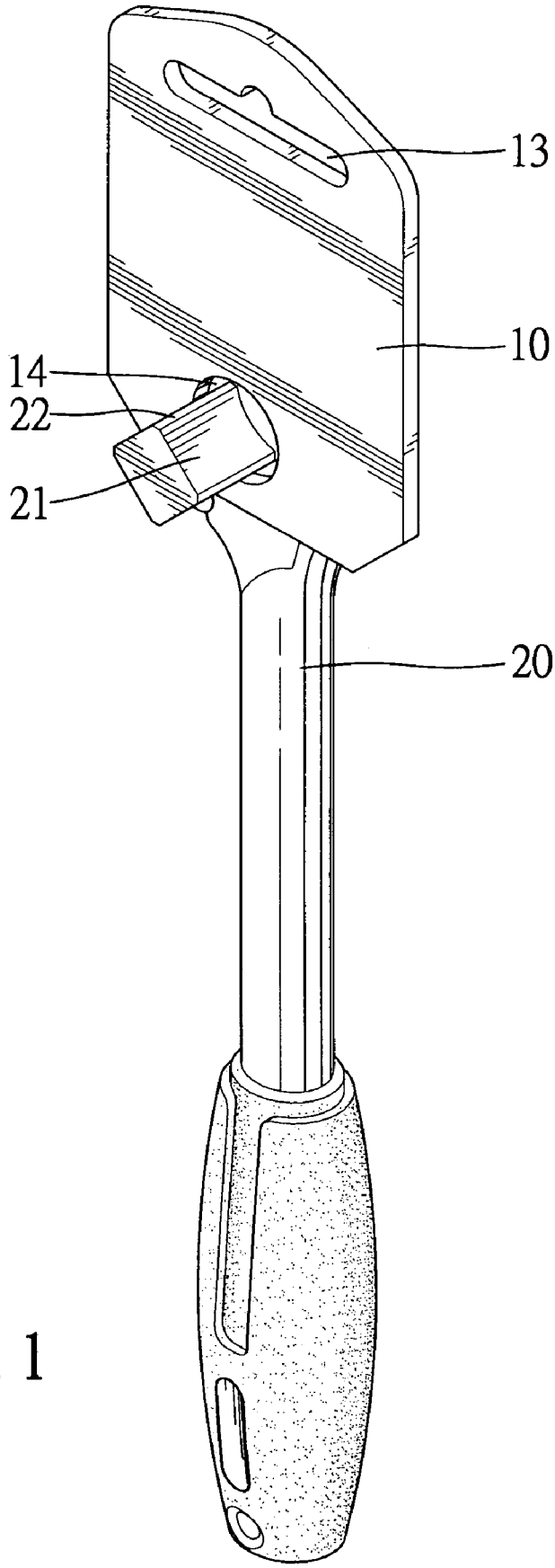
FIG. 1 is a perspective view of a wrench hung on a hanger according to a first embodiment of the present invention.
Figure 2:
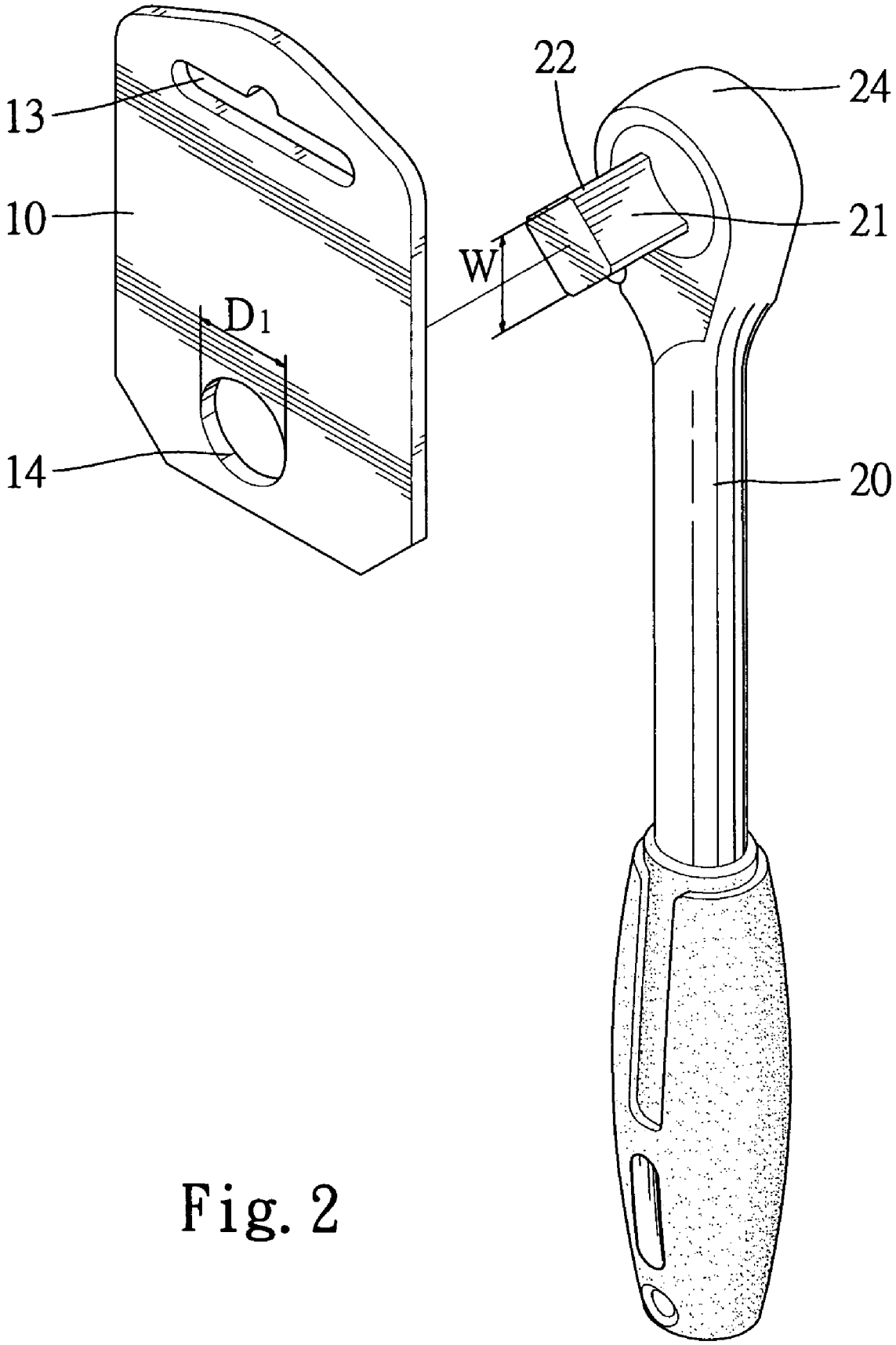
FIG. 2 is similar to FIG. 1, but shows the wrench taken from the hanger.
Figure 3:
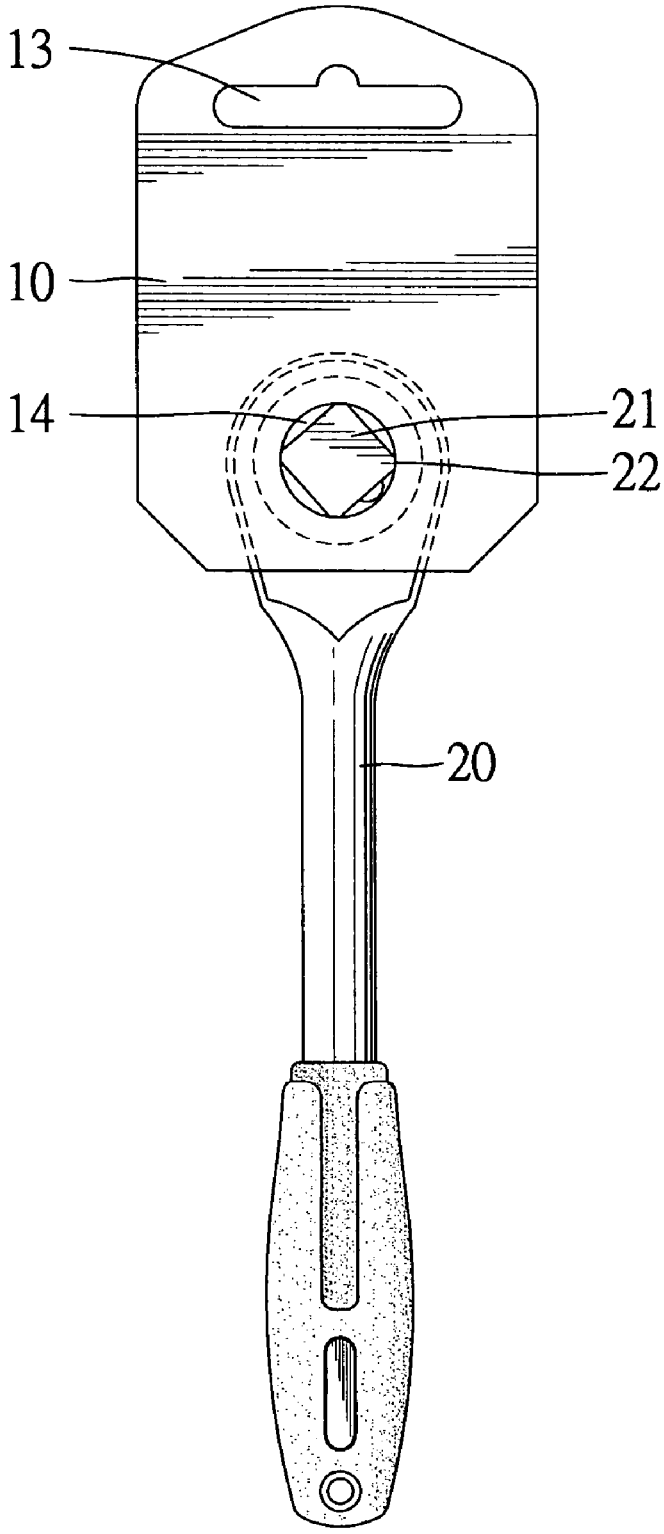
FIG. 3 is a rear view of the hanger shown in FIG. 1.

FIGS. 1 to 3 show a hanger according to a first embodiment of the present invention. A selective one-way wrench 20 can be hung on the hanger.

The hanger includes a board 10, a slot 13 defined in an end thereof and an aperture 14 defined in an opposite end thereof.

The selective one-way wrench 20 includes a box end 24. A square insert 21 is attached to the box end 24. The square insert 21 includes four corners 22 formed thereon. Although not shown as being conventional, a selective one-way driving mechanism is provided between the square insert 21 and the box end 24. In a first mode, the box end 24 can drive the square insert 21 in a first direction, but not vice versa. In a second mode, the box end 24 can drive the square insert 21 in a second direction opposite to the first direction.

The diameter D1 of the aperture 14 is marginally smaller than the diagonal distance W of the square insert 21. Thus, the square insert 21 can be forced and retained in the aperture 14.

Figure 4:
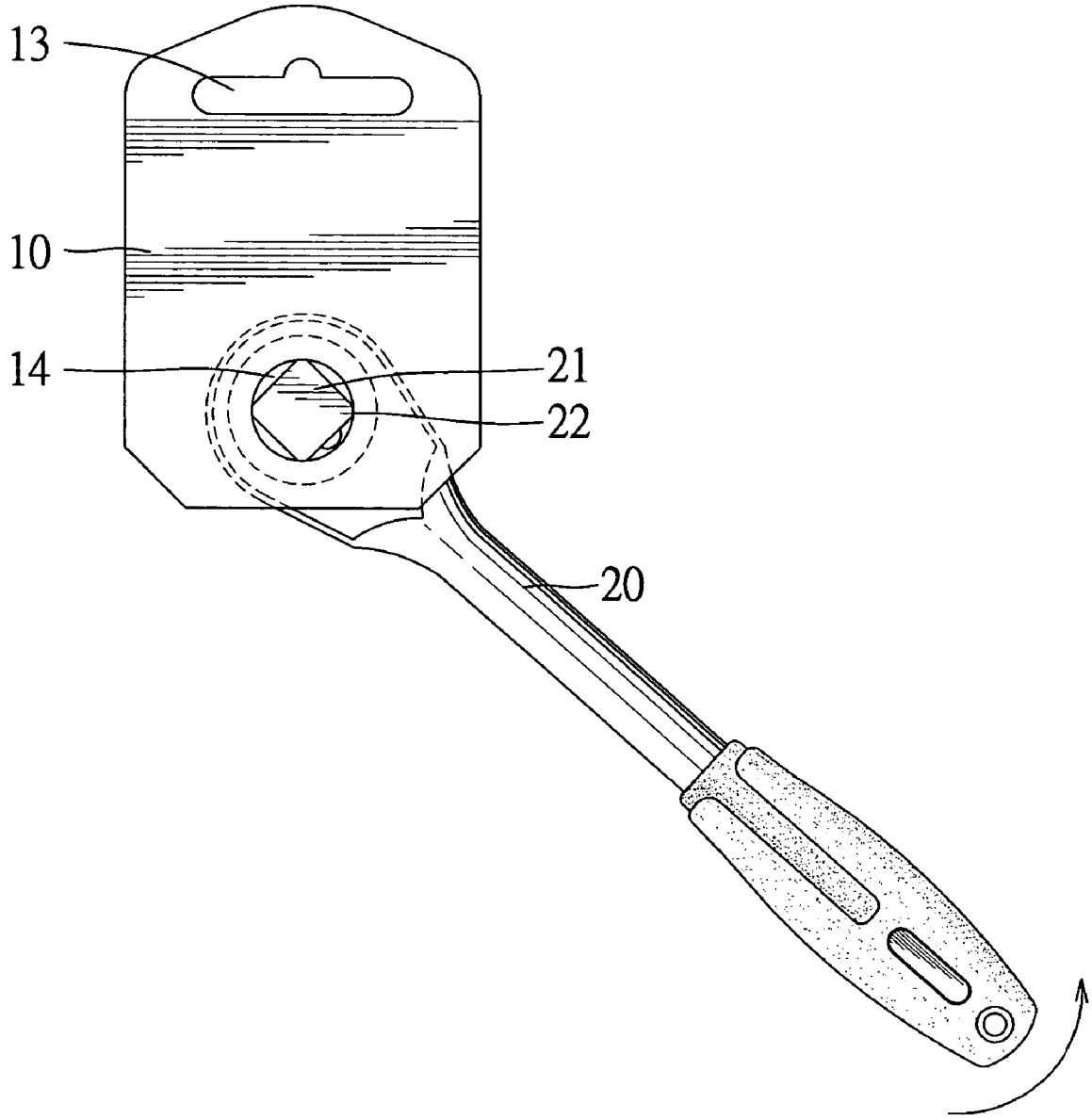
FIG. 4 is similar to FIG. 3, but shows a handle of the wrench rotated in a direction.

Referring to FIG. 4, the wrench 20 is in the second mode. Friction between the edge of the aperture 14 and the corners 22 is adequate to hold the square insert 21 in position when the wrench 20 is rotated in the first direction relative to the board 10.

Figure 5:
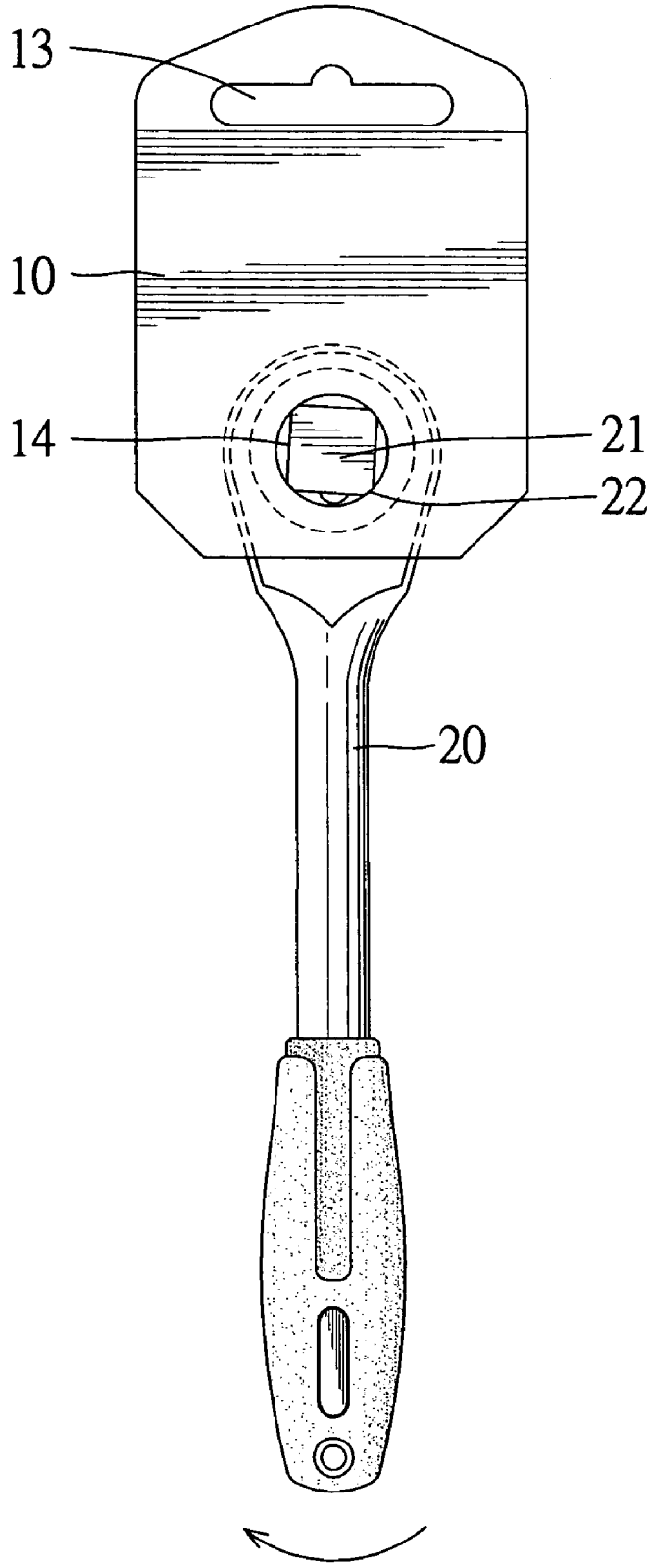
FIG. 5 is similar to FIG. 4, but shows the handle of the wrench rotated in an opposite direction.

Referring to FIG. 5, the friction between the edge of the aperture 14 and the corners 22 is inadequate to hold the square insert 21 in position when the wrench is rotated in the second direction.

Figure 6:
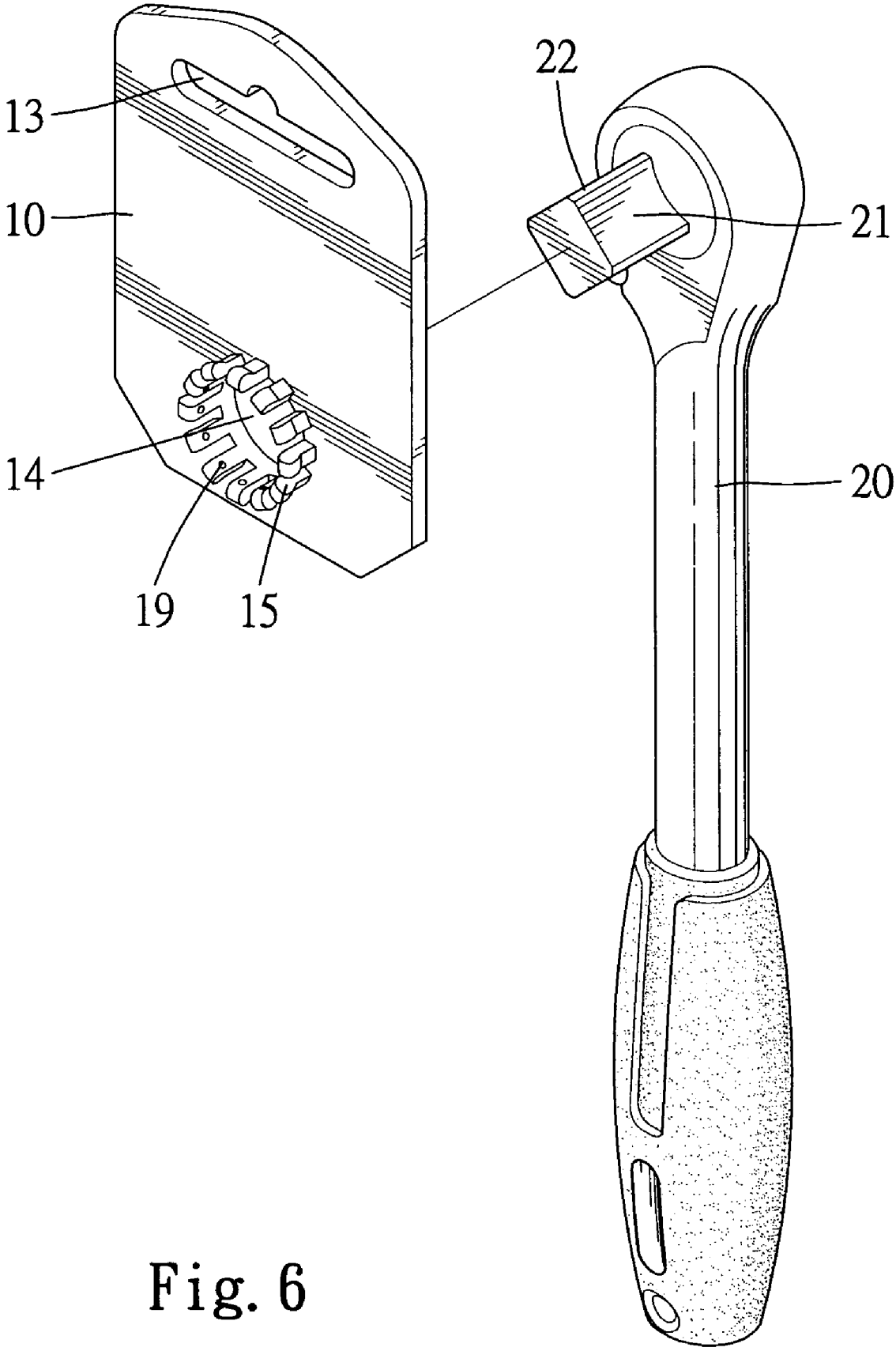
FIG. 6 is a perspective view of a wrench and a hanger according to a second embodiment of the present invention.

FIG. 6 shows a hanger according to a second embodiment of the present invention. The second embodiment is identical to the first embodiment except for several things. Firstly, fingers 15 project from a side of the board 10 for holding the square insert 21 of the wrench 20. Secondly, each of the fingers 15 includes a boss 19 formed thereon for contact with the square insert 21 of the wrench 20. Thirdly, each of the fingers 15 is an elastomer.

Figure 7:
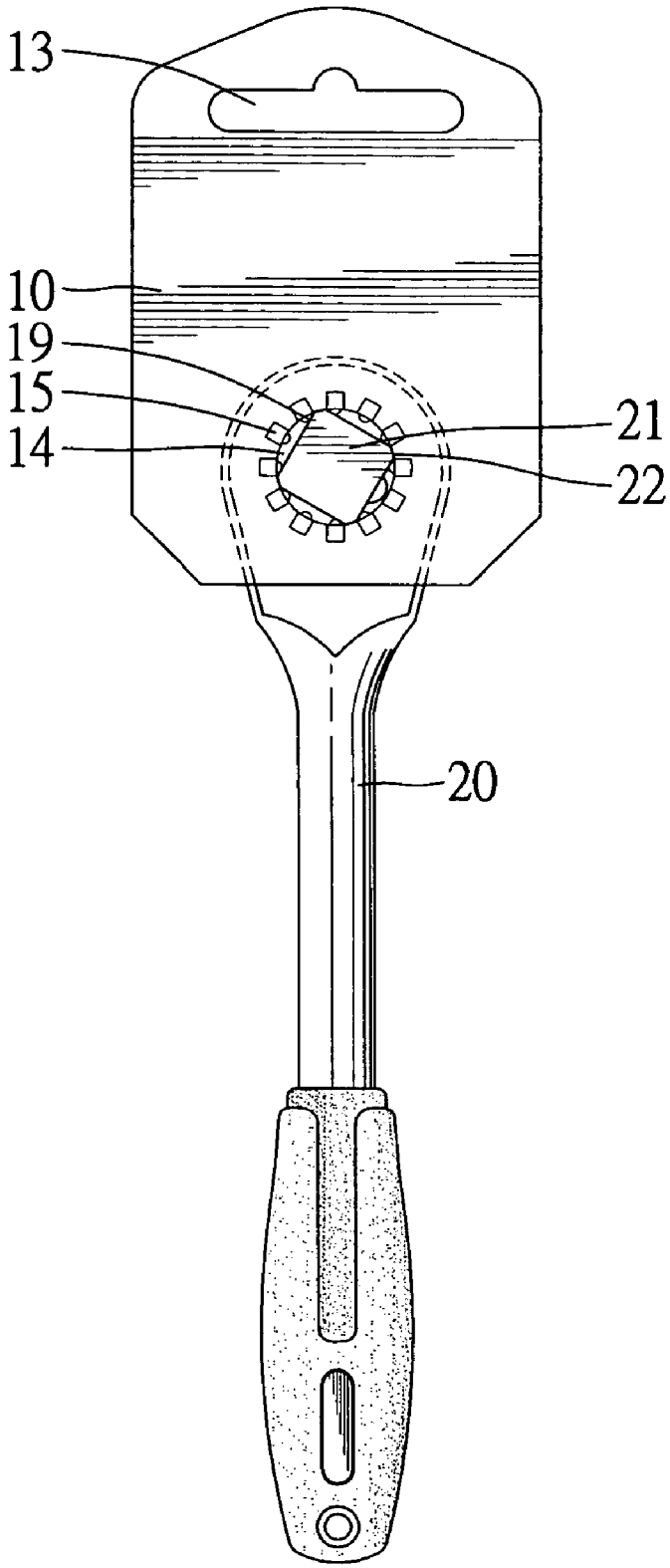
FIG. 7 is a rear view of the wrench and the hanger of FIG. 6.

FIG. 7 shows the wrench 20 attached to the hanger. The bosses 19 extend from the fingers 15 for an adequate distance so that adjacent two of them can pinch one of the corners 22.

Figure 8:
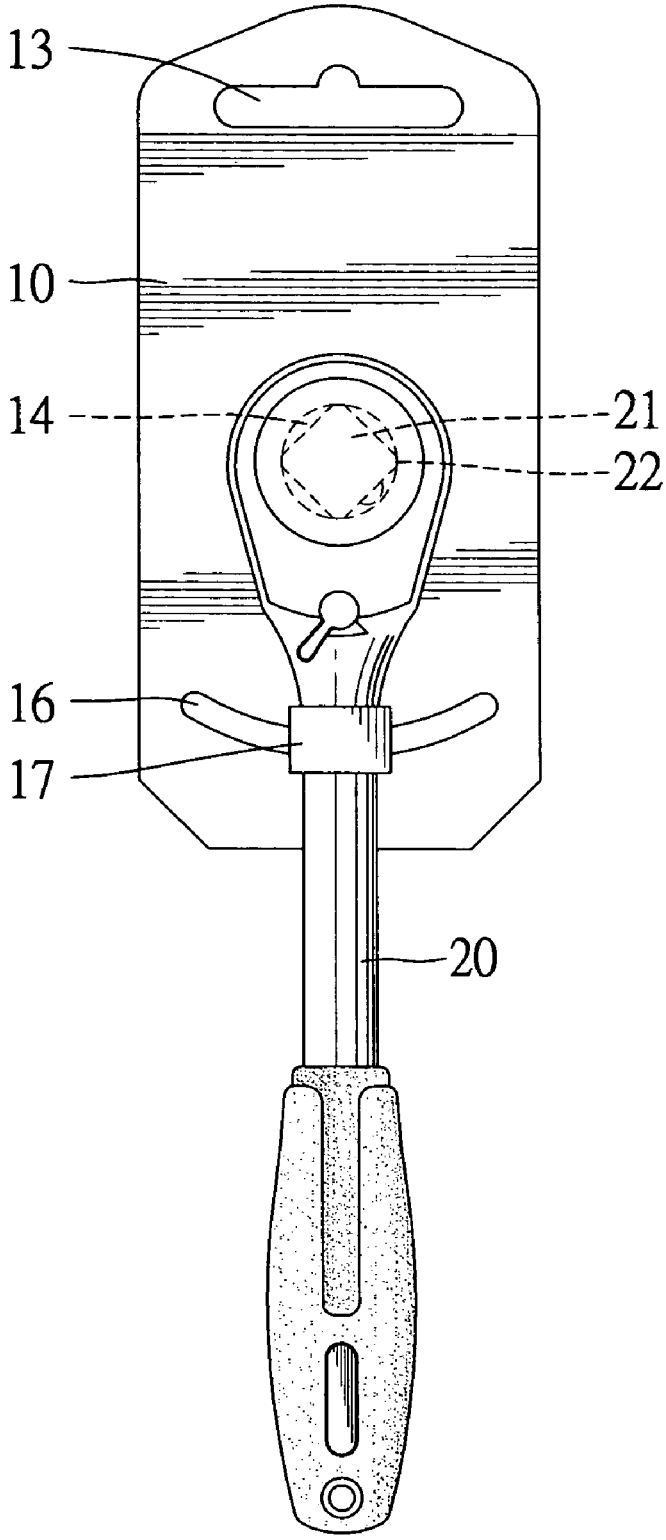
FIG. 8 is a perspective view of a wrench and a hanger according to a third embodiment of the present invention.

FIG. 8 shows a hanger according to a third embodiment of the present invention. The third embodiment is identical to the first embodiment except for several things. Firstly, the hanger includes a cambered slot 16 defined in an end thereof opposite to the slot 13. Secondly, a restraint 17 is connected with the wrench 20 on one hand and inserted in the cambered slot 16 on the other hand.

Figure 9:
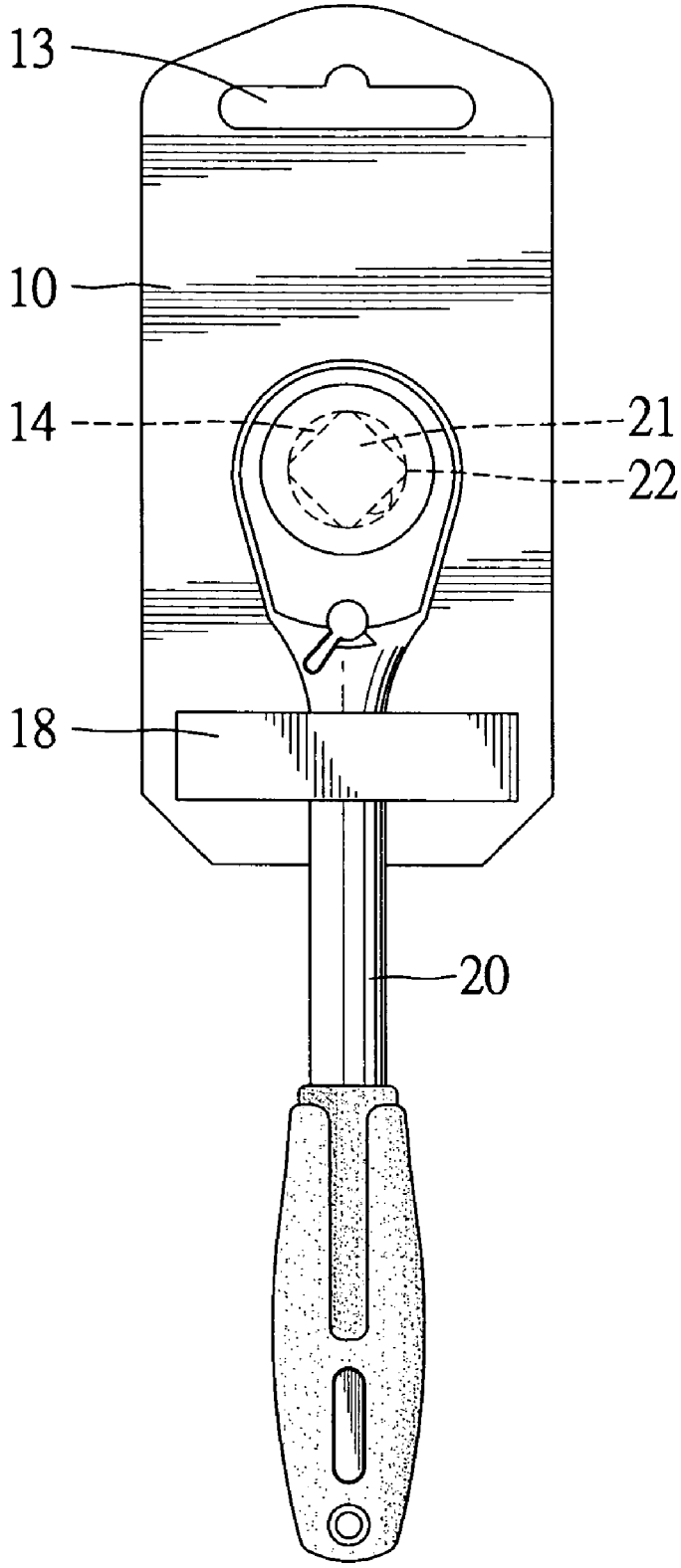
FIG. 9 is a front view of a wrench and a hanger according to a fourth embodiment of the present invention.

FIG. 9 shows a hanger according to a fourth embodiment of the present invention. The fourth embodiment is identical to the first embodiment except for including a restraint 18 formed at an end of the board 10 opposite to the slot 13. The restraint 18 may be a strap with two ends connected with the board 10 for restraining the wrench 20 between the restraint 18 and the board 10.

Figure 10:
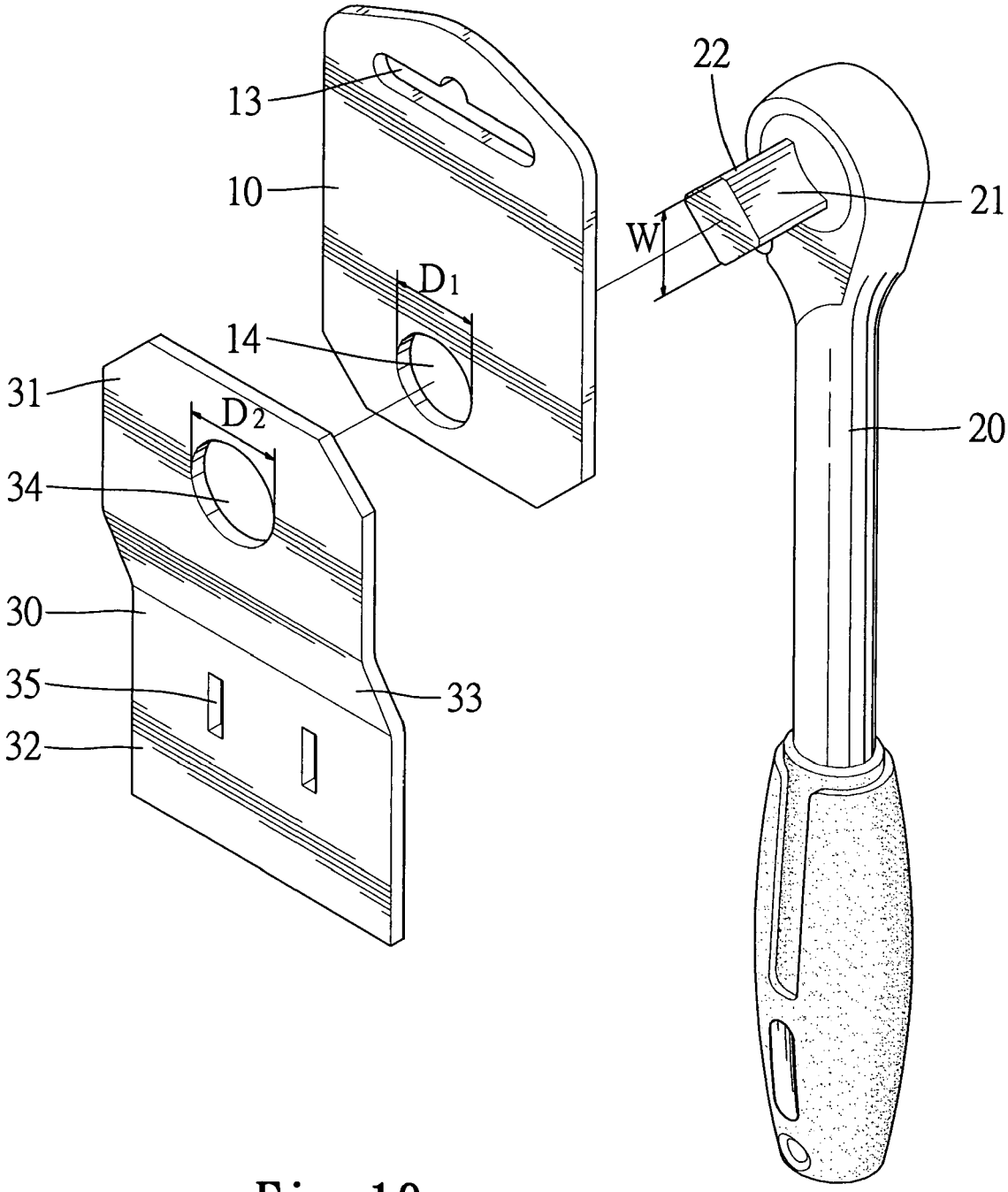
FIG. 10 is a perspective view of a wrench and a hanger according to a fifth embodiment of the present invention.
Figure 11:
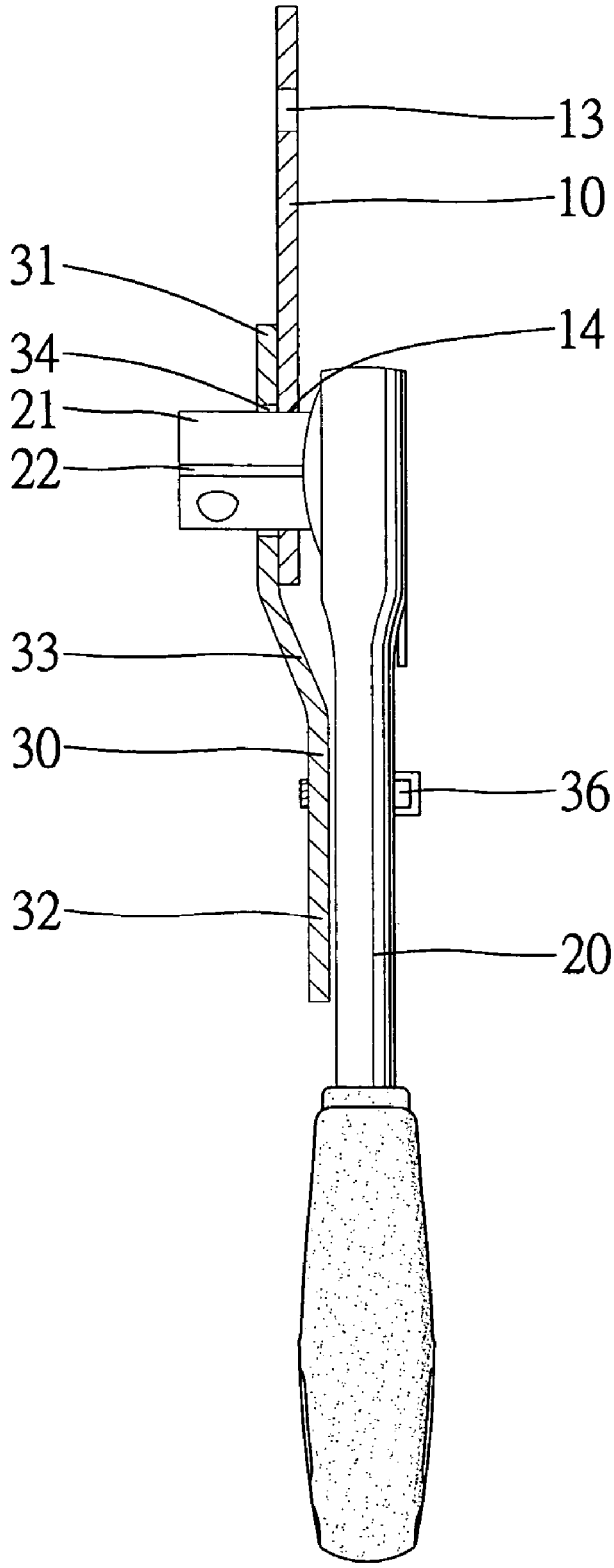
FIG. 11 is a cross-sectional view of the hanger of FIG. 10.
Figure 12:
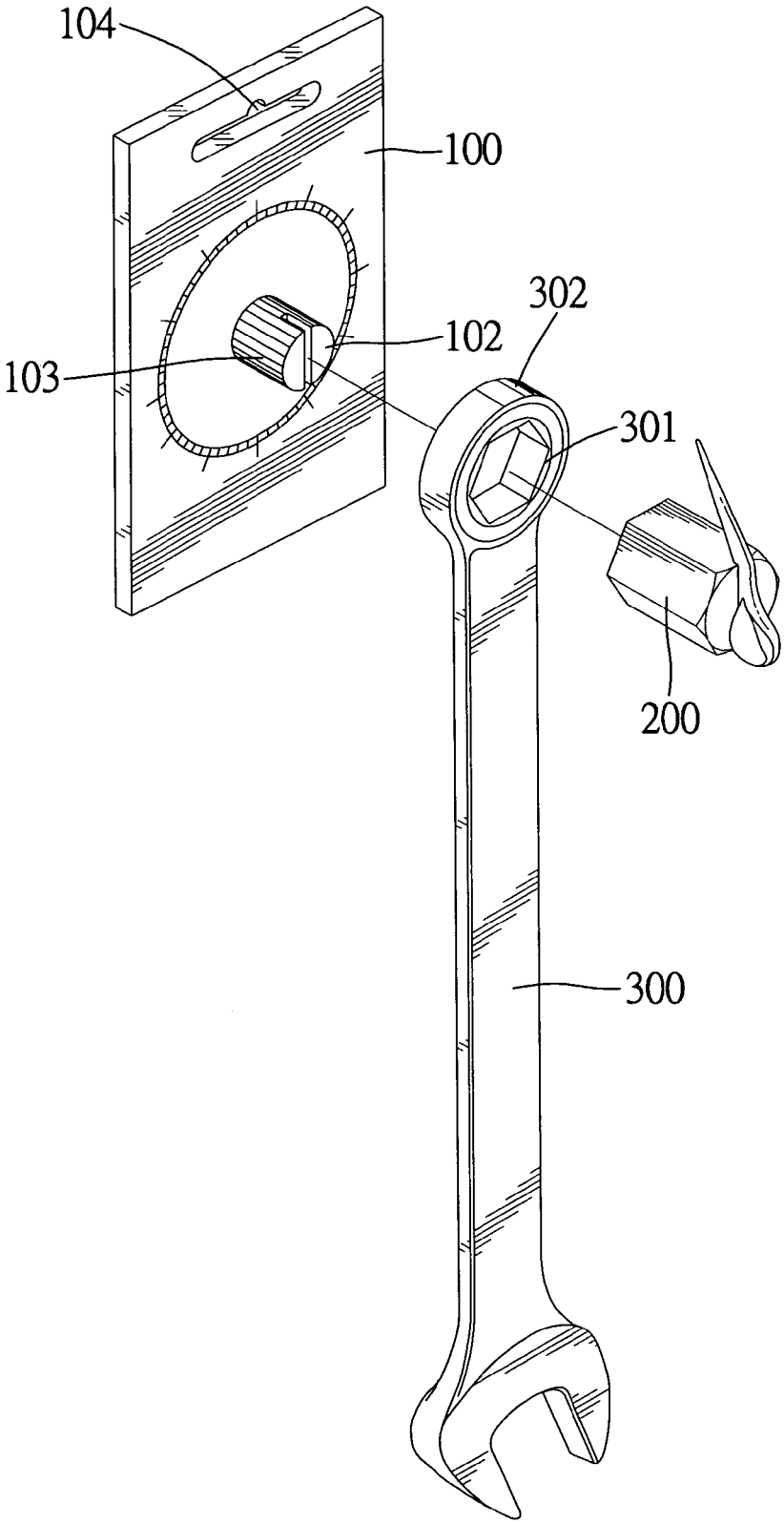
Fig. 12 PRIOR ART
FIG. 12 is a perspective view of a wrench and a conventional hanger.

FIGS. 10 and 11 show a hanger according to a fifth embodiment of the present invention. The fifth embodiment is identical to the first embodiment except for including a retaining board 30 and a restraint 36. The retaining board 30 includes a first portion 31, a second portion 33 extending obliquely from the first portion 31 and a third portion 32 extending substantially perpendicularly from the second portion 33. The first portion 31 includes a bore 34 defined therein. The third portion 32 includes two apertures 35 defined therein. The diameter D2 of the bore 34 is larger than the diagonal distance W of the square insert 21 of the wrench 20. The bore 34 is aligned with the aperture 14 so that the square insert 21 can be inserted into the bore 34 through the aperture 14.

FIG. 11 shows the board 10 located between the wrench 20 and the retaining board 30. The restraint 36 includes two ends each including a bolt (not shown) for engagement with a nut (not numbered). The restraint 36 is used for restraining the retaining board 30 to the wrench 20. Thus, the board 10 is firmly attached to the wrench 20 by the retaining board 30.

The present invention has been described through detailed illustration of the embodiments. Those skilled in the art can derive variations from the embodiments. The embodiments hence shall not limit the scope of the present invention defined in the claims.

What is claimed is

1. A combination of a hanger and a wrench, with the wrench having a handle including a box end, with a square insert attached to the box end, with the wrench including a selective one-way driving mechanism between the square insert and the box end; with the hanger comprising:

a hanger board;

a first aperture having a first diameter and an axis, with the first aperture located on the hanger board and adapted to receive the insert of the wrench;

a retaining board separately formed from the hanger board, with the retaining board being pivotal relative to the hanger board about the axis of the first aperture; and a retainer attached to the retaining board for holding the handle of the wrench, wherein the retainer is pivotal with the retaining board relative to the hanger board;

wherein the insert is a square insert, wherein the first diameter of the first aperture is marginally smaller than a diagonal distance of the square insert;

wherein the retaining board has a bore adapted to receive the insert, with the bore having a second diameter, and with the first diameter of the first aperture of the hanger board being smaller than the second diameter of the bore of the retaining board, with the second diameter being larger than the diagonal distance of the square insert.

2. The combination according to claim 1 wherein an edge of the first aperture holds the insert in position because of friction.

3. The combination according to claim 2 wherein the square insert comprises four corners formed thereon, wherein the friction is formed between the edge of the first aperture and the four corners so that the friction is adequate to hold the square insert in position when the wrench is rotated.

4. The combination according to claim 1 further comprising a holding aperture defined in the hanger board receiving an object secured to a wall.

5. The combination according to claim 4 wherein the holding aperture is a slot.

6. The combination according to claim 1 wherein the retainer is a strap with two ends connected to the retaining board.

7. The combination according to claim 1 wherein the hanger board is located between the retaining board and the wrench.

8. The combination according to claim 1, with the first aperture is aligned with the bore creating a single opening adapted to simultaneously receive the insert.

9. The combination according to claim 8 further comprising a restraint aperture defined in the retaining board, with the retainer receivable in the restraint aperture.

10. The combination according to claim 8 wherein the retaining board further comprises a first portion, a second portion and a third portion, with the second portion intermediate to the first and third portions, with the second portion obliquely angle from the first portion and the third portion, with the first portion, the third portion and the hanger board being parallel to each other, wherein the hanger board is intermediate the first portion and the third portion, with the first and third portions extending from the second portion in a direction perpendicular to the axis of the first aperture.

11. The combination according to claim 10 with the retainer further comprising two ends, wherein the third portion of the retaining board comprises two retaining apertures, with each of the two retaining apertures receiving one of the two ends of the retainer.

12. The combination according to claim 1 wherein the retaining board further comprises a first portion, a second portion and a third portion, with a second portion intermediate to the first and third portions, with the second portion obliquely angled from the first portion and the third portion, with the first portion, the third portion and the hanger board being parallel to each other, wherein the hanger board is intermediate the first portion and the third portion, with the first and third portions extending from the second portion in a direction perpendicular to the axis of the first aperture.

* * * * *